United States Patent [19]

Sloyan

[11] 4,063,420

[45] Dec. 20, 1977

[54] REPETITIVE CLOSED RANKINE CYCLE WORKING FLUID AS MOTIVE POWER FOR PRIME MOVER

[75] Inventor: Jerome J. Sloyan, Trenton, N.J.

[73] Assignee: George W. Bishop, Princeton, N.J.

[21] Appl. No.: 605,647

[22] Filed: Aug. 18, 1975

[51] Int. Cl.[2] ..... F01K 25/08

[52] U.S. Cl. ..... 60/671

[58] Field of Search ..... 60/651, 671; 252/67

[56] References Cited

U.S. PATENT DOCUMENTS

| | | | |
|---|---|---|---|
| 3,234,734 | 2/1966 | Buss et al. | 60/651 |
| 3,516,248 | 6/1970 | McEwen | 60/651 |

*Primary Examiner*—Allen M. Ostrager
*Attorney, Agent, or Firm*—Edward F. Connors

[57] ABSTRACT

Propionic acid is the working fluid in a repetitive closed Rankine Cycle power plant system.

5 Claims, 2 Drawing Figures

SCHEMATIC ARRANGEMENT OF THE CLOSED RANKINE CYCLE

SCHEMATIC ARRANGEMENT OF THE CLOSED RANKINE CYCLE

TABLE 1

Figure 1:
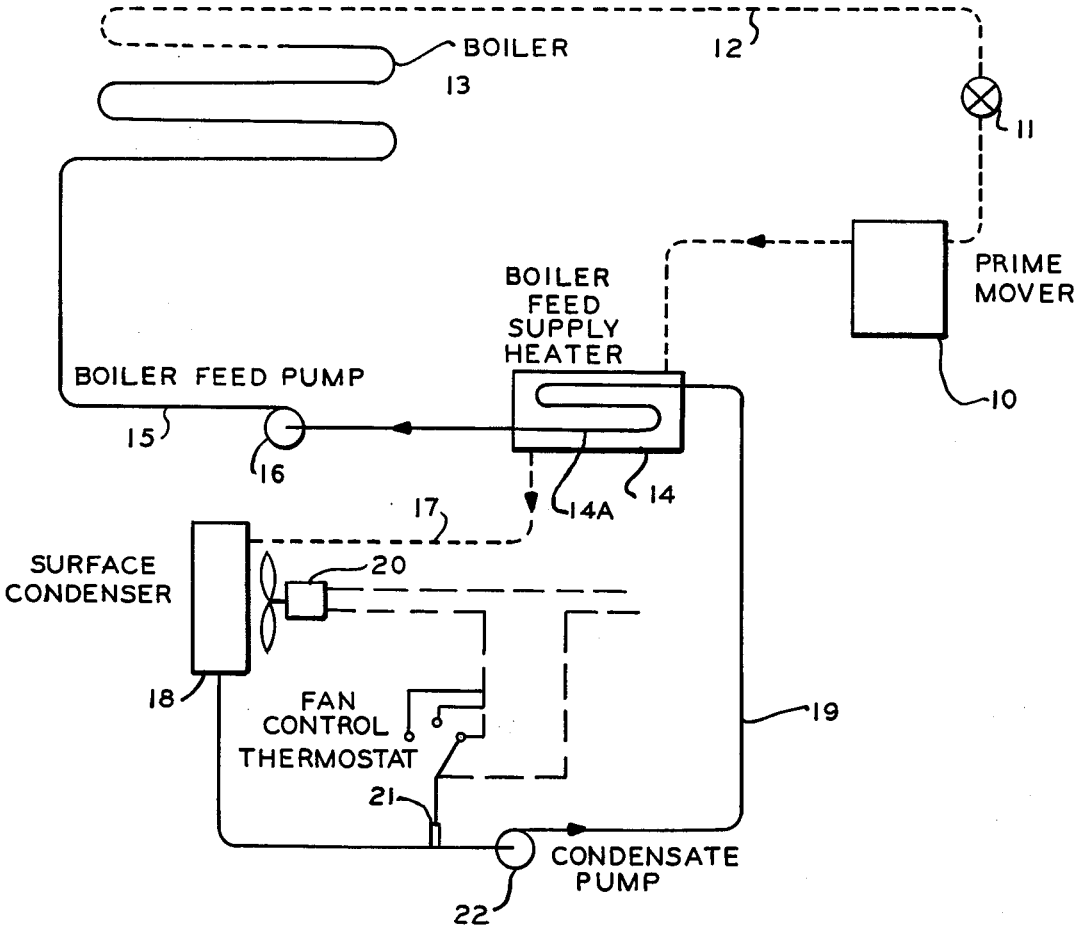

| PRESS. PSIA | TEMP. T°F | SPEC VOLUME CU. FT. PER LB. | BTU./LB. HEAT CONTENT SAT. LIQUID | BTU./LB. HEAT CONTENT SAT. VAPOR | BTU/LB. LATENT HEAT OF VAPORIZATION | BTU/LB.-°F ENTROPY SAT. LIQUID | BTU/LB.-°F ENTROPY VAPORI-ZATION | BTU/LB.-°F ENTROPY SAT. VAPOR |
|---|---|---|---|---|---|---|---|---|
| 0.19 | 104 | 423.43 | 40.32 | 265.32 | 223 | 0.0764 | 0.3918 | 0.4682 |
| 0.77 | 150 | 114.19 | 66.08 | 276.08 | 210 | 0.1203 | 0.3442 | 0.4645 |
| 1.93 | 186 | 48.50 | 86.24 | 287.24 | 201 | 0.1524 | 0.3111 | 0.4635 |
| 7.74 | 252 | 13.33 | 123.20 | 308.20 | 185 | 0.2069 | 0.2598 | 0.4667 |
| 14.7 | 286 | 7.35 | 143.05 | 319.05 | 176 | 0.2341 | 0.2359 | 0.4700 |
| 29.4 | 320 | 3.84 | 162.60 | 325.60 | 163 | 0.2600 | 0.2089 | 0.4689 |
| 73.5 | 367 | 1.63 | 190.25 | 334.25 | 144 | 0.2947 | 0.1741 | 0.4688 |
| 147 | 398 | 0.846 | 208.77 | 336.77 | 128 | 0.3171 | 0.1492 | 0.4663 |
| 294 | 428 | 0.437 | 227.10 | 341.10 | 114 | 0.3385 | 0.1290 | 0.4675 |
| 600 | 454 | 0.2207 | 243.37 | 344.17 | 100.80 | 0.3570 | 0.1103 | 0.4673 |
| 647 | 500 | 0.2150 | 273.21 | 352.70 | 79.49 | 0.3902 | 0.0828 | 0.4730 |
| 696 | 550 | 0.2102 | 307.59 | 363.34 | 55.75 | 0.4268 | 0.0552 | 0.4820 |
| 743 | 600 | 0.2061 | 345.51 | 374.50 | 29.99 | 0.4667 | 0.0283 | 0.4950 |
| 784 | 645 | 0.2042 | 384.72 | 384.72 | 0 | 0.5075 | 0 | 0.5075 |

TABLE 1-A

TABLE 1-B

| INITIAL PRESS. PSIA | INITIAL TEMP. T°F | CONDITIONS AFTER ISENTROPIC EXPANSION OF THE VAPOR PSIA | T°F | HEAT CONTENT. BTU./LB. SAT. VAPOR | SUP. HT. VAPOR | TOTAL HT. IN VAPOR | VAPOR TO BE CONDENSED | BTU/LB. SAT. LIQUID | BTU./LB. IN VAPOR TO BE CONDENSED AFTER HEATING BOILER FEED SUPPLY |
|---|---|---|---|---|---|---|---|---|---|
| 600 | 454 | 1.93 | 191 | 287.24 | 2.55 | *289.79 | 203.55 | 86.24 | |
| 647 | 500 | 1.93 | 198 | 287.24 | 6.12 | 293.36 | 207.12 | 86.24 | |
| 696 | 550 | 1.93 | 210 | 287.24 | 12.24 | 299.48 | 213.24 | 86.24 | 209.88 |
| 743 | 600 | 1.93 | 227 | 287.24 | 20.91 | 308.15 | 221.91 | 86.24 | 216.31 |
| 784 | 645 | 1.93 | 249 | 287.24 | 32.13 | 319.37 | 233.13 | 86.24 | 224.17 |

*NOT SHOWN ON FIG. 4 GRAPH

TABLE 2

CYCLE EFFICIENCY

| INITIAL PSIA | INITIAL TEMP. °F | DIRECT TO CONDENSER | THRU FEED FLUID HEATER |
|---|---|---|---|
| 600 | 454 | $\frac{344.17 - 289.70}{344.17 - 86.24} = \frac{54.38}{257.93} = 21.08\ \%$ | |
| 647 | 500 | $\frac{352.70 - 293.36}{352.70 - 86.24} = \frac{59.34}{266.46} = 22.27\ \%$ | |
| 696 | 550 | $\frac{363.34 - 299.48}{363.34 - 86.24} = \frac{63.86}{277.10} = 23.05\ \%$ | $\frac{363.34 - 296.12}{363.34 - 89.60} = \frac{67.22}{273.74} = 24.55\ \%$ |
| 743 | 600 | $\frac{374.50 - 308.15}{374.50 - 86.24} = \frac{66.35}{288.26} = 23.02\ \%$ | $\frac{374.50 - 302.55}{374.50 - 91.84} = \frac{71.95}{282.66} = 25.45\ \%$ |
| 784 | 645 | $\frac{384.72 - 319.37}{384.72 - 86.24} = \frac{65.35}{298.48} = 21.89\ \%$ | $\frac{384.72 - 310.41}{384.72 \quad 95.20} = \frac{74.31}{289.52} = 25.66\ \%$ |

TABLE 2-A

TABLE 2-B

| | | | |
|---|---|---|---|
| 740 | 600 | $\frac{1276.7 - 945}{1276.7 - 154} = \frac{331.7}{1222.7} = 29.54\%$ | 20 % MOISTURE |
| 775 | 640 | $\frac{1301.5 - 955}{1301.5 - 154} = \frac{346.5}{1147.5} = 30.19\ \%$ | 18.5 % MOISTURE |

TABLE 3

LBS. OF ATMOSPHERIC AIR REQUIRED TO CONDENSE (1) LB. OF VAPOR

| BTU./LB. OF VAPOR TO BE CONDENSED TO 186°F AND 1.93 PSIA | | | DIRECT TO CONDENSER | | | | | AFTER PASSING THRU FEED FLUID HEATER | | |
|---|---|---|---|---|---|---|---|---|---|---|
| | | | 203.55 | 207.12 | 213.24 | 221.91 | 233.13 | 209.88 | 216.31 | 224.17 |
| ATMOSPHERE T °F | ATMOS. AIR TEMPERATURE FACTOR | AIR LEAVING CONDENSER T °F | | | | | | | | |
| 100 | 1.40 | 138 | 22.15 | 22.54 | 23.20 | 24.15 | 25.07 | 22.83 | 23.52 | 24.38 |
| 90 | 1.28 | 132 | 20.25 | 20.61 | 21.21 | 22.08 | 22.92 | 20.88 | 21.50 | 22.30 |
| 80 | 1.18 | 125 | 18.67 | 19.00 | 19.55 | 20.36 | 21.14 | 19.24 | 19.82 | 20.35 |
| 70 | 1.08 | 120 | 17.08 | 17.39 | 17.89 | 18.63 | 19.34 | 17.61 | 18.14 | 18.81 |
| 60 | 1.00 | 113 | 15.82 | 16.10 | 16.57 | 17.25 | 17.91 | 16.31 | 16.80 | 17.42 |
| 50 | 0.93 | 108 | 14.71 | 14.97 | 15.41 | 16.04 | 16.66 | 15.17 | 15.62 | 16.20 |
| 40 | 0.87 | 102 | 13.76 | 14.00 | 14.42 | 15.01 | 15.58 | 14.19 | 14.62 | 15.16 |

REPETITIVE CLOSED RANKINE CYCLE WORKING FLUID AS MOTIVE POWER FOR PRIME MOVER

BACKGROUND OF THE INVENTION

The present invention relates to new and novel improvements in repetitive closed Rankine Cycle power plant systems which comprise a boiler, an engine, a feed line from the boiler to the engine to supply a working fluid thereto and a return line for the fluid from the engine to the boiler.

GENERAL CONSIDERATIONS

Propulsion of engines, both reciprocating and rotary (turbine) by steam under pressure, produced from boiling water, has been a common practice, but is largely in disfavor for such uses as powering automobiles and for other outdoor uses as power generating plants of which home electric generators and well pumps are examples. There are numerous causes for that disfavor, of which mention can be made of cold weather freezing water during idle periods of the equipment; also the low differential between steam vacuum temperature and summer ambient temperature used for air-cooled condensers. Furthermore, attempts to utilize a mechanical mixture of two liquids proves to be a failure, as each ingredient has its own boiling point and will not function as a unitary stable chemical combination.

OBJECTS OF THE INVENTION

The objects of the invention are to provide a stable unitary chemical composition both in liquid and in vaporized condition of more favorable character than water, more specifically, the invention proposes a fluid having a boiling or vaporizing temperature higher than the boiling temperature of water at atmospheric pressure, more definitely, it may be stated that the invention seeks and attains provision of a fluid having a boiling or vaporizing temperature point high enough to enable ambient temperature of air, at the not unusual temperature of 100° F or more, to be used as a coolant to effect condensation of the vapor after it has performed its work; a further object of the discovery or invention is to provide a fluid the liquid whereof has a freezing temperature point much below that of water and below temperatures most likely to be encountered in practice. In this connection, a fluid is sought and has been discovered which not only possesses the foregoing attributes, but unlike water, does not expand upon freezing to thereby preclude threat of damage to equipment; other objects, advantages and beneficial results will appear as the description proceeds.

DRAWINGS

Figure 2:
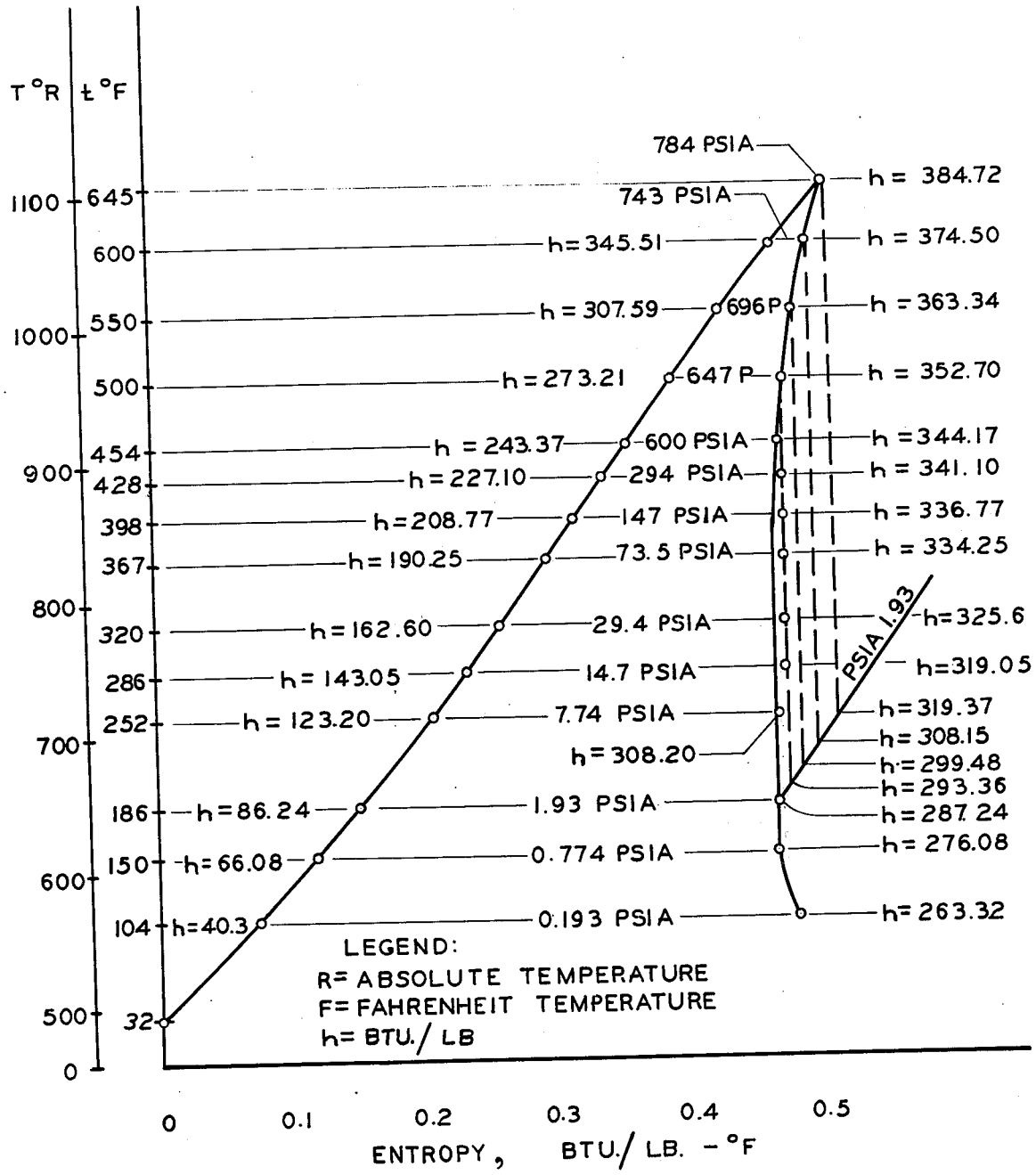

FIG. 1 is a schematic assembly of equipment constituting a closed Rankine cycle power plant;

Table 1 tabulates functions and conditions obtained with propionic acid at chosen pressures and corresponding temperatures at which the liquid vaporizes;

Table 1-A is a continuation of the tabulation of Table 1, showing conditions after isentropic expansion of the vapor;

Table 1-B, shown in conjunction with Table 1-A gives one column of values of BTU (British Thermal Units) per pound of the vapor after it has passed through the boiler-feed-supply heater;

Table 2 shows figures and calculations of ideal cycle efficiency with the used vapor going directly to the condenser;

Table 2-A supplements Table 2 showing figures and calculations of ideal cycle efficiency when using the vapor for heating of the boiler-feed-supply heater;

Table 2-B is included for comparison purposes, showing ideal cycle efficiency calculations with water used as the working fluid;

Table 3 shows pounds of atmospheric air required to condense 1 pound of vapor with the air having known temperatures in the range between 40° F and 100° F;

FIG. 2 is a graph of the vaporization of the propionic acid plotted with values of temperature versus entropy utilizing values from the Tables mentioned above.

THE PROBLEM

Historically,, steam engines for powering automobiles were produced and marketed for a brief period a long time ago, but due to faults and difficulties arising from the use of water, the era of the steam automobile was short lived, and over the long span of years from then until now extensive research and effort has been exerted to accomplish a solution to the problem to make the steam-engine type of automobile practical. I have discovered a material having advantageous capabilities corresponding to water and steam, but having none of the disadvantages thereof. It is a material remote from thermodynamics, namely, is a material presently in universal use as a preservative for food and grain, and also as a component of a non-dairy substitute for cream which is being served in many eating places for use with coffee. It has also been used in the cosmetic field. Engineers and scientists have paid no attention to nor given recognition to possibilities this material might have in the field of thermodynamics, whereas, by my discovery and research, the material possesses great potential as a working fluid with beneficial physical and chemical properties.

SOLUTION TO THE PROBLEM

I have discovered that the involved problem is completely solved by utilization in a closed cycle Rankine assembly using a prime mover of the steam-engine type, a working fluid comprising propionic acid (sometimes called propanoic acid) $C_3H_6O_2$. To avoid confusion, however, it is immediately called to attention that there are two other substances, namely methyl acetate and ethyl formate, which have the same chemical formula and molecular weight as propionic acid but have differences therefrom which exclude them from use for solving the problem. Specifically, whereas propionic acid has a boiling point of 286° F, the lower boiling points of only 137° F for methyl acetate and 129° F for ethyl formate, both of which are much lower than the boiling point of water, eliminate those two variations of the acid from utilization as the working fluid or engine propellant.

DESCRIPTION

Propionic acid, the proposed form of $C_3H_6O_2$, possesses the following chemical and physical properties:

Density — 8.2 lbs./gal.
Molecular weight — 74.08
Boiling point — 286° F
Freezing point — −4° F
Critical pressure — 784 Psia
Critical temperature — 645° F Specific heat of liquid — 0.56 BTU/lb. at 60° F & 14.7 Psia Latent heat of vaporization — 176 BTU/lb. at 286° F & 14.7 Psia Flash point — 110°/150° F It is a non-toxic fluid.

It is classified by ICC as non-flammable.

It is commercially available.

It can be used in conjunction with conventional metals inclusive of 316 stainless steel, 3003 aluminum, and others.

It does not deteriorate in repetitious use.

It may be fully confined in use in a closed Rankine cycle.

Since water and liquid propionic acid are substantially the same density, and the specific heat of water at 60° F is approximately 1.0, and the specific heat of liquid propionic acid at 60° F is 0.56, it has been assumed that by multiplying the specific heat of water at a given temperature by a factor of 0.56 that a close approximation of the specific heat of liquid propionic acid at the same respective temperature could be obtained. The BTU/lb. of liquid propionic acid shown in Table 1, has been determined on this basis.

The latent heat of vaporization for the several listed temperatures were obtained by applying the Hildebrand function. (see Marks Handbook) The relative smoothness of the vapor line which extends substantially vertically between 186° F and 450° F on the graph of FIG. 2, indicates satisfactorily that the specific heats of the liquid and latent heats of vaporization as determined by the methods described are adequately accurate.

Where isentropic expansion begins at any temperature above 454° F and expansion occurs at 100% efficiency, the vapor immediately becomes superheated. And if isentropic expansion were to begin at any temperature below 454° F and expansion occurs at less than 100% efficiency, the vapor would also be superheated. In view of these circumstances, the vapor may well be treated as a gas and formula $V=RT/P$ applies, where $V$ is specific volume in cu. ft. per pound, $P$ is absolute pressure in pounds per square foot, $T$ is $K$ scale temperature degrees, and $R$ is a constant for the particular gas, which for propionic vapor is 20.865; derived by usual mode of calculation for a gas, wherein summation of the molecular weights of the ingredients is a factor, and for the propionic acid formula $C_3H_6O_2$ the total is 74 when adding the molecular weights of 36, 6 and 32 of the carbon, hydrogen and oxygen respectively that are present. Said constant of 20.865 was used in compiling Table 1.

However, it may be pointed out that propionic acid is a carboxylic acid and as such possesses molecular association. It appears that the vapor contains a large number of double molecules $(C_3H_6O_2)_2$ are these double molecules split up into single molecules as the temperature is increased. Consequently the molecular weight of the vapor may be as much as from 50 to 100 percent more than the molecular weight of 74 derived as explained above. Due to the presence of the mentioned molecular association, the value of R is decreased as the molecular weight of the substance is increased. And since V varies as R, the actual specific volumes, which can only be determined by experiment, will be substantially lower than those shown in Table 1.

Where isentropic expansion begins at a temperature of 450° F or higher, the vapor immediately becomes super-heated as shown in Table 1-A, as evidenced by the vertical dashes shown to the right of the vapor line on the graph of FIG. 2. These isentropic expansions are recorded in Table 1-A at progressive intervals, namely at 454° F, 500° F, 550° F, 600° F and 645° F, terminating each at a pressure of 1.93 Psia respectively at temperatures of 191° F, 198° F, 210° F, 227° F and 249° F with each shown plotted with dash lines in the graph of FIG. 4. If the vapor in this super-heated condition, after expansion, were to pass directly from the prime mover, to the condenser, the result would be a substantial loss of heat and corresponding lower efficiency. By first passing the superheated vapor exhausting from the prime mover, through a boiler-feed-supply heater, some of the heat contained in the vapor will be transferred to the liquid awaiting injection into the boiler. All of this is accomplished with use of a closed circuit of travel for the fluid, both liquid and vapor. As a result, the decrease in enthalpy of the vapor combined with the increase in temperature of the liquid entering the boiler increases the overall efficiency of the closed cycle. (See Tables 1-B, 2 and 3)

It seems appropriate at this point to offer comparison and comments concerning corresponding efficiencies of water-steam energy systems. To assist in making such comparison, the values shown in Table 2-B were obtained from Keenan and Keyes' steam tables, and from Ellenwood and Mackey's vapor charts; the latter providing the values after isentropic expansion at 100% expansion efficiency. It is quite possible that expansion efficiencies of 75% can be obtained with a turbine, but in a counterflow engine these efficiencies might very well be reduced by 30% or more, due to the effect of cylinder condensation. Whereas propionic acid vapor, after isentropic expansion contains some degree of superheat, as shown in Table 1-A, at 1.93 psia its temperature is 191° F, or higher, whereas at the same pressure in its dry saturated state its temperature is 186° F indicating that cylinder condensation, and loss in efficiciency due to it, are not likely to occur with propionic acid.

Giving attention now to the diagrammatic showing in FIG. 1 of the specific equipment assembly of Rankine type power plant closed cycle for the inclusion of the above described propionic acid as the working fluid, numeral 10 indicates a conventional or other prime mover or engine which may be driven by vapor pressure admitted thereto by appropriately opening an individual throttle valve 11 in the supply pipe line 12 thereto from a boiler 13. The boiler contains the fluid propionic acid heated to temperatures and pressures of desired amounts by a suitable burner (not shown).

After the vapor has performed its work in the engine, it preferably is conducted to a tank 14 functioning as a boiler-feed-supply preheater where the partially spent vapor gives up an additional portion of its heat content, thereby affording initial or preheating of the liquid which is passing through coils **14*a* in said tank awaiting entry into the boiler by way of feed line 15 under propulsive actuation by a pump 16 in said line. As shown in Table 1-B a considerable conservation of energy is thereby obtained. Vapor still remaining in the tank 14 is passed by a pipe line 17 to a surface condenser 18 and after being condensed is taken by a return pipe 19 back through coils 14*a* and then to the boiler 13**.

The condenser provides a passageway therethrough closed to escape of the vapor or its condensate, said passageway providing exterior surface of considerable area exposed to passage of air there-across for promoting condensation of the vapor. The air flow may be under influence of an electric fan 20. A thermostat 21 in the return pipe line 19 controls operation of the fan to afford proper air flow under prevailing ambient air conditions in accordance with the need indicated in Table 3. Advancement of the condensed liquid from the condenser 18 back through coil 14*a* may be assured by a pump 22 interposed in return pipe line 19.

It will be recognized that the fluid in the system is repetitiously re-used, and is completely contained within a closed cycle of operation so that in the absence of unintentional leakage requires no replenishment under normal operating conditions.

CONCLUSIONS

As the working fluid applied to the closed Rankine cycle and similar applications, Propionic acid has many advantages.

1. Where isentropic expansion begins at 454° F or higher, and continues until a pressure of 1.93 psia. is attained, at an expansion efficiency of 100%, the vapor is in a superheated state. Where isentropic expansion begins at less than 454° F, and continues until a pressure of 1.93 psia. is attained, and expansion occurs at less than 100% efficiency, the vapor will also be in a superheated state.

2. Utilizing some of the heat contained in the superheated expanded vapor to raise the temperature of the condensate prior to its entrance to the boiler, substantially improves the efficiency. (See Table 2-A)

3. Compared with steam over the same range of temperatures and pressures, steam appears to be theoretically efficient. However, if engine heat losses are ignored, it should be noted that at the end of expansion steam contains from 18 to 20% moisture. Furthermore, the efficiency of steam as shown in Table 2-B, ignores the loss resulting from cylinder condensation, which in a counterflow engine may result in a reduction in efficiency of 30% or more.

4. The application of Propionic acid as a working fluid is universal in that sub-freezing temperatures will not result in damage to equipment, since it does not expand when it freezes and because of the effectiveness of atmospheric air as a coolant to effect the condensation.

5. Propionic acid as the working fluid in the closed Rankine cycle in combination with atmospheric air as the coolant to effect efficient condensation of the vapor, results in a very desirable combination for a variety of mobile types of equipment and for instance, for the solar heating and air conditioning systems becoming so prevalent in arid regions it holds much promise.

6. Last but not least, because of being externally fired, the products of combustion are much less polluting to the atmosphere, that the products resulting from an internal combustion engine.

I claim:

1. A Rankine Cycle power plant system comprising a boiler, an engine, a feed line from said boiler to supply working fluid therefrom to said engine, and a return line from said engine to said boiler to recirculate the working fluid through said system, wherein said working fluid is propionic acid.

2. A Rankine Cycle system according to claim 1 wherein the system is substantially sealed against loss of fluid whereby an initial charge of said fluid is repetitively used in said cycle.

3. A Rankine Cycle system according to claim 1 wherein a pre-heater tank is interposed in said return line.

4. A Rankine Cycle system according to claim 1 including an air cooled condenser in said return line.

5. A Rankine Cycle system according to claim 4 wherein the air cooling is thermostatically controlled.

* * * * *